US005404283A

United States Patent [19]

Yantz et al.

[11] Patent Number: 5,404,283

[45] Date of Patent: Apr. 4, 1995

[54] OUTDOOR FRAMING PROJECTOR

[75] Inventors: Rupert O. Yantz, West Bend; Richard A. Johnson, Milwaukee; Martin J. Peck, Germantown, all of Wis.

[73] Assignee: Phoenix Products Company, Inc., Milwaukee, Wis.

[21] Appl. No.: 861,181

[22] Filed: Mar. 31, 1992

[51] Int. Cl.[6] ..... F21V 29/00; F21V 31/00

[52] U.S. Cl. ..... 362/267; 362/277; 362/294

[58] Field of Search ..... 362/158, 187, 267, 268, 362/277, 319, 321, 294

[56] References Cited

U.S. PATENT DOCUMENTS

| | | | |
|---|---|---|---|
| 1,398,531 | 11/1921 | Wackwitz . | |
| 2,354,237 | 7/1944 | Wendel | 240/26 |
| 2,770,715 | 11/1956 | Stecher | 240/11.2 |
| 3,639,751 | 2/1972 | Pichel | 240/47 |
| 3,919,542 | 11/1975 | Castic | 240/41.55 |
| 4,001,572 | 1/1977 | Stein | 240/25 |
| 4,021,660 | 5/1977 | Szpur | 240/41.55 |
| 4,138,713 | 2/1979 | Szpur | 362/218 |
| 4,299,070 | 11/1981 | Oltmanns et al. | 52/309.11 |
| 4,321,659 | 3/1982 | Wheeler | 362/293 |
| 4,458,303 | 7/1984 | Berns | 362/321 |
| 4,489,366 | 12/1984 | Roznecki | 362/270 |
| 4,546,420 | 10/1985 | Wheeler et al. | 362/268 |
| 4,612,607 | 9/1986 | Segoshi et al. | 362/267 |

(List continued on next page.)

FOREIGN PATENT DOCUMENTS

| | | |
|---|---|---|
| 0112994 | 7/1984 | European Pat. Off. . |
| 0301236 | 2/1989 | European Pat. Off. . |
| 1449627 | 8/1966 | France . |
| 2254998 | 7/1975 | France . |
| 2370922 | 6/1978 | France . |

(List continued on next page.)

OTHER PUBLICATIONS

"Phoenix Heavy Duty Marine and Industrial Lighting" Catalog of Phoenix Products Company, Inc., admitted prior art. no date.

Applicant's Exhibit No. 1, one page brochure entitled "New Micro Ellipse", of Theatre Service and Supply Corp., 1792 Union Ave., Baltimore, Md. 21211.

Applicant's Exhibit No. 2, advertisement entitled "MR Low Voltage Pattern and Framing Projector 75", of Times Square Lighting, Industrial Park, Stoney Point, N.Y. 10980.

Applicant's Exhibit No. 3, one page brochure entitled "Casino Light", of ARC Lighting, 72 Loring Ave., Salem, Mass. 01970.

(List continued on next page.)

*Primary Examiner*—Richard R. Cole

*Attorney, Agent, or Firm*—Quarles & Brady

[57] ABSTRACT

A luminaire especially adapted for use as an outdoor framing projector is weatherproof and has an optical system for projecting a beam of a variable size and focus. A housing made in extruded sections has a longitudinally continuous sealed joint between the sections formed by a dog-leg shaped lip on one adjacent section fitting into a correspondingly shaped recess on the other section, with a resilient sealing strip compressed between the lip and recess and a detent holding the lip and recess together. A fan forced interior air recirculation cooling system cools a lamp with the warmed air flowing longitudinally back to front past top and side walls of the housing provided with cooling fins and a return air duct adjacent to the bottom wall drawing air from the front of the housing back to the inlet of the fan. Daylight adjustment of the lamp relative to the reflector is allowed by providing the reflector with two holes which allow two reference beams to escape which are aligned with reference marks in the housing at the proper adjustment position. Lenses are supported from longitudinal flanges of the housing by bearing blocks which trap longitudinally running cylindrical bearings against the flanges and have clamp stands to secure the positions of the lenses.

2 Claims, 7 Drawing Sheets

U.S. PATENT DOCUMENTS

| | | | |
|---|---|---|---|
| 4,630,182 | 12/1986 | Moroi et al. | 362/294 |
| 4,658,338 | 4/1987 | Bertozzi | 362/226 |
| 4,701,833 | 10/1987 | Bornhorst | 362/299 |
| 4,729,078 | 3/1988 | Skegin | 362/294 |
| 4,739,456 | 4/1988 | Little | 362/268 |
| 4,768,135 | 8/1988 | Kretschmer et al. | 362/277 |
| 5,042,048 | 8/1991 | Meyer | 362/268 |
| 5,068,768 | 11/1991 | Kobayashi | 362/277 |
| 5,190,368 | 3/1993 | Sekiguchi | 362/277 |
| 5,285,056 | 3/1994 | Peck | 362/267 |

FOREIGN PATENT DOCUMENTS

| | | | |
|---|---|---|---|
| 163690 | 6/1922 | Germany . | |
| 1772284 | 3/1971 | Germany . | |
| 2757614 | 6/1979 | Germany . | |
| 256447 | 8/1926 | United Kingdom | 362/321 |

OTHER PUBLICATIONS

Applicant's Exhibit No. 4, two page brochure entitled "Mini-Casino Light", of ARC Lighting, 72 Loring Ave., Salem, Mass. 01970.

Applicant's Exhibit No. 5, two page brochure entitled "Lekolite Spotlite 2205 Strand Century", of Strand Century, Inc., 18111 S. Santa Fe Ave., P.O. Box 9004, Rancho Dominguez, Calif. 90224.

Applicant's Exhibit No. 6, two page brochure entitled "Parallelipsphere", of Electro Controls, Inc., 2975 S. 300 West, Salt Lake City, Utah 84115.

Applicant's Exhibit No. 7, two page brochure entitled "Catalog No. 1KL6-2040Z 500-1000 watt 1KL ellipsoidal", of Altman Stage Lighting Co., Inc., 57 Alexander St., Yonkers, N.Y. 10701.

Applicant's Exhibit No. 8, nine page literature of LTM Corporation of America, 11646 Pendleton St., Sun Valley, Calif. 91352-2501, describing "The LTM Korrigan 1200 1200W HMI Long Throw Followspot", The LTM Hobbit 1200 1200W HMI Short Throw Followspot, the Puck HMI Follow Spot 1200 and the Poxie 575 HMI Follow Spot.

Applicant's Exhibit No. 9, two page brochure entitled "LEE Colortran International® Operating Instructions For Zoom Ellipsoid", of LEE Colortran, 1015 Chestnut St., Burbank, Calif., 91506-9983.

Applicant's Exhibit No. 10, two page brochure entitled "Berkey Colortran® Zoom Ellipse catalog No. 213-165", of Berkey Colortran, Inc., 1015 Chestnut St., Burbank, Calif. 91502.

FIG. 1
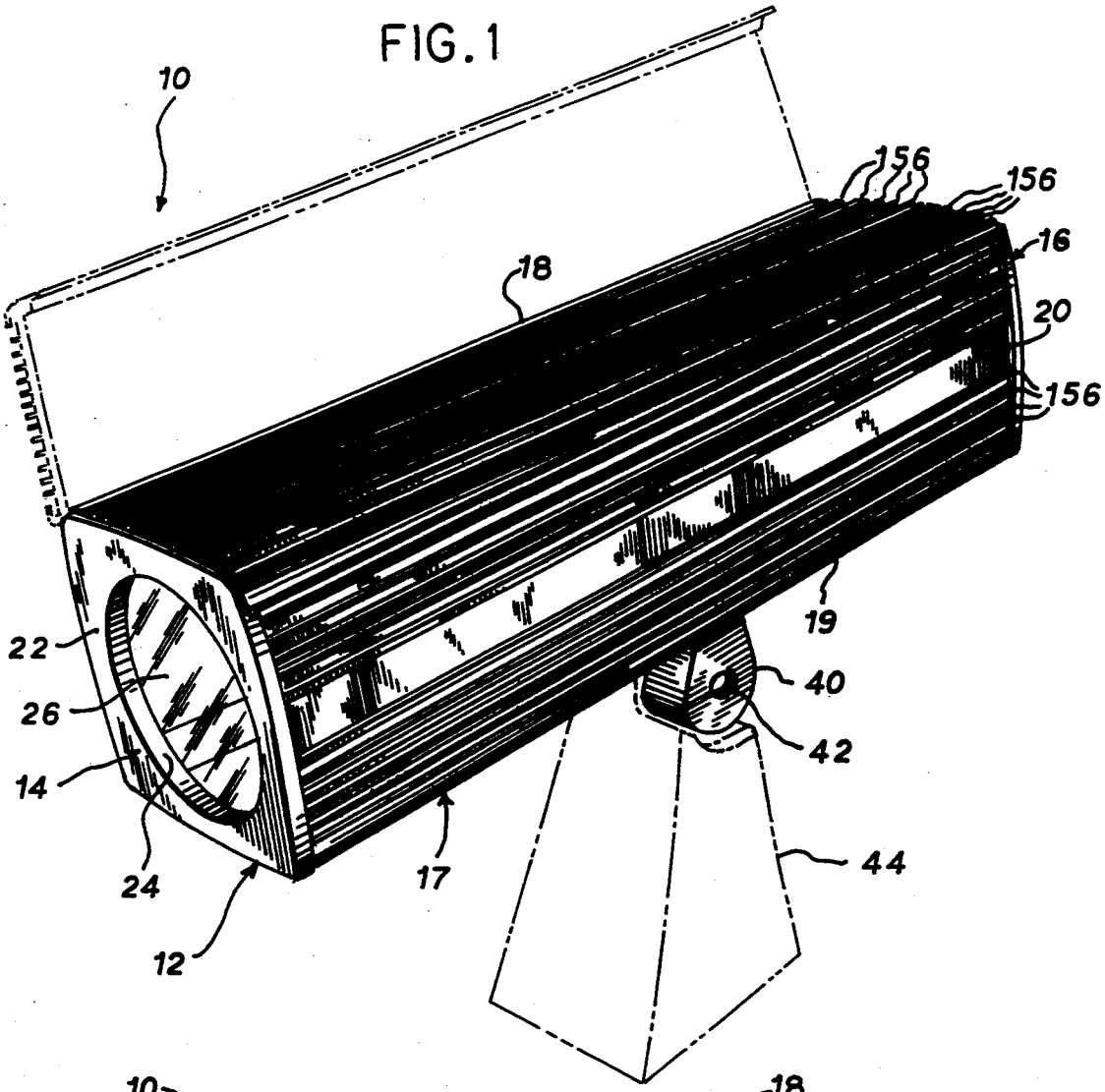
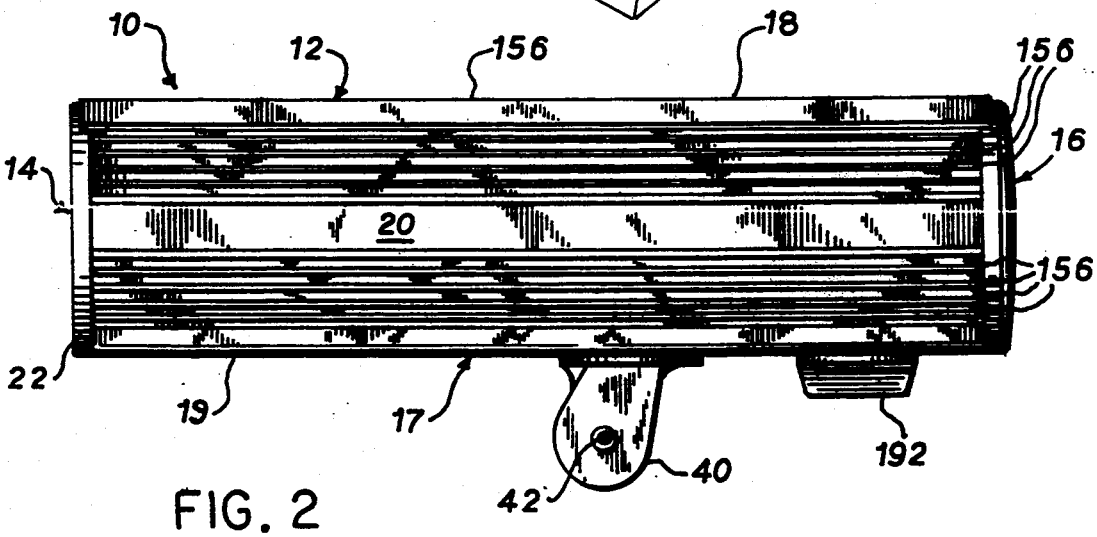
FIG. 2

FIG. 14
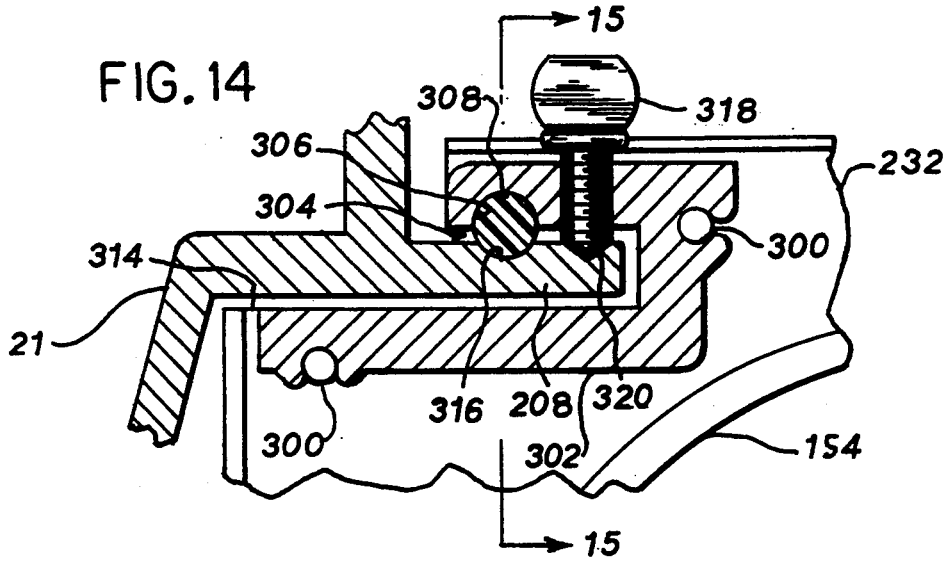
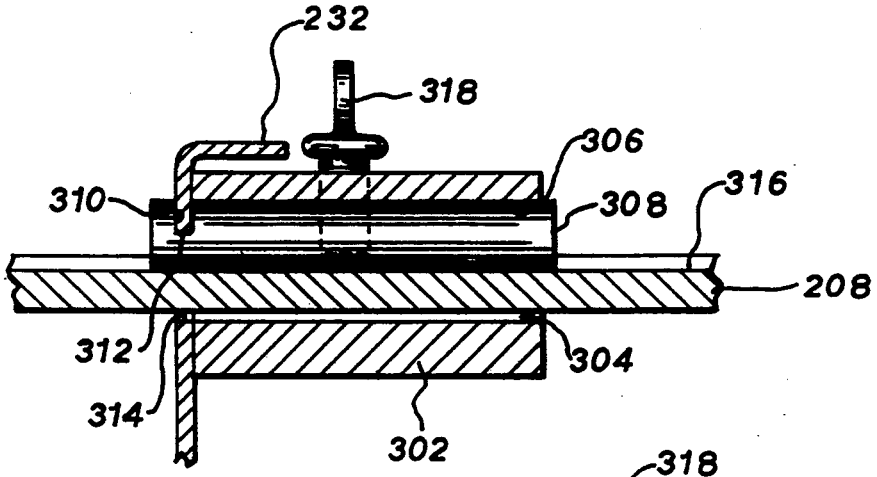
FIG. 15
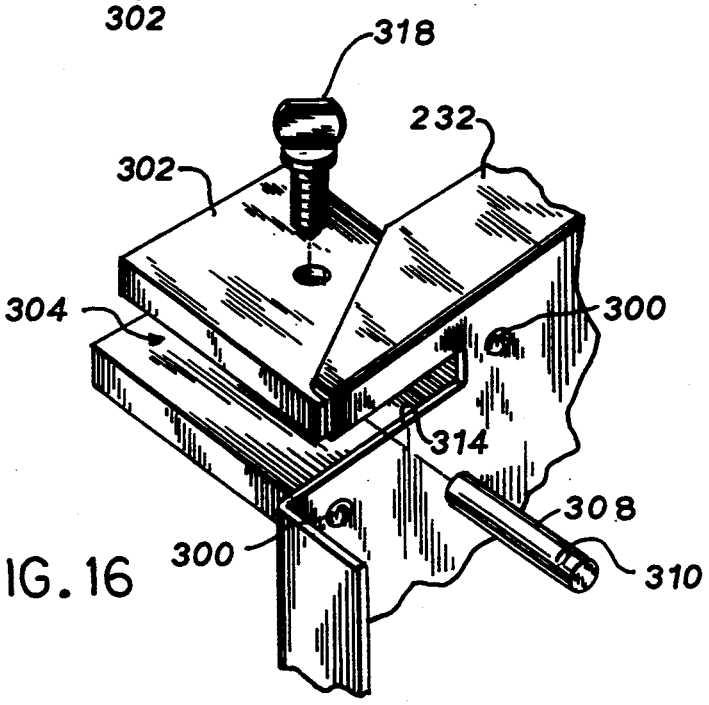
FIG. 16

OUTDOOR FRAMING PROJECTOR

FIELD OF THE INVENTION

This invention relates to an outdoor luminaire having precision optics to project a focusable beam of any shape or pattern.

BACKGROUND OF THE INVENTION

Indoor framing projectors are well known for use in theatrical productions. They provide an adjustable focus relatively high intensity beam of light to highlight or create features on stage. Therefore, they have a light bulb or light source, an adjustable focus optical system and may have pattern templates or shutters which can be inserted into the optical system so as to project a certain pattern of light. For example, using a pattern template, a portion of the beam can be shaded so that either the shaded part or the illuminated part looks like a tree or other object, or words. Filters may also be used with these projectors to project different colors of light.

Such projectors have typically been for strictly indoor uses. Electrically, such projectors would be unreliable if subjected to an outdoor environment. However, a framing projector may find many applications outdoors. For example, outlines of specific architectural features such as facias, recesses, entryways, murals or other details could be highlighted. Sharp outlines of the light beam would make interior or exterior features glow uniformly without an apparent source of the beam. Logos or signage could also be projected on a surface, for example the side of a building. Multiple colors or images could be time faded. Changing templates within the projector could announce different events, such as retail sales or concerts.

Moreover, precise control over the cutoff and shape of a light pattern can eliminate light or glare in unwanted areas, thereby reducing light trespass. Rooftops, flags or details around windows could be illuminated without a desirable spill into the windows or into neighboring areas. Entrances, statues or sidewalks could be illuminated without glare on pedestrians or motorists.

Many other applications also exist. For example, sculptures, statues, tables or showroom merchandise could appear to glow by projecting precise outlines of the object from the projector location. Emergency egress directions or other warnings could also be projected. In such applications, illumination could be provided from outside typically inaccessible areas such as hazardous areas, high temperature areas or smoke stacks.

Hundreds of available patterns and colors could create dynamic murals of light. Unattractive buildings or industrial cites such as tank farms could be painted with colored shapes or images. Switching or fading could causes these images to be continually changing or animated. Abstract or realistic scenes could be created to suggested time, place or mood. Artistic images could be easily changed to fit a season or event. Examples include multi-colored geometric patterns, cityscapes, foliage shadows, outdoor scenes such as a desert, seashore, mountain or countryside, sunsets, rainbows, thematic patterns, flags, clouds, stars, window openings, trees and many more.

Moreover, architectural features such as trim, motif or facia designs could be inexpensively or temporarily created by projecting them on otherwise blank surfaces. Designs could be verified prior to construction. Landscapes could be enhanced, such as an effect of moonlight through trees could be projected, or tree images could be projected onto walls. Paths could be sharply defined with glare-free light. Moreover, indefinite mounting locations and obstacles or last minute changes could be easily accommodated with the flexibility of aiming, zoom, focus, shutter and pattern adjustments.

However, prior framing projectors were not suited for such outdoor applications. For one thing, the prior projectors were not weatherproof. Weatherproofing creates a problem not only because the projector must be rainproof, windproof, sunproof, dirt and dust proof, but also because the light source within the projector is high intensity and creates a considerable amount of heat. The light source must therefore be cooled or it will have a very short life. In many prior framing projectors, cooling of the light source was achieved either by convection or with a fan forced flow of air from outside the projector. However, such cooling creates problems with the entry of water, dirt and dust to the interior of the projector in outdoor applications.

Moreover, an outdoor framing projector must have a relatively long throw, or range, through which it must be able to project a visible, focusable image. The optical system required to provide a long range requires a relatively large housing. Since it is for an outdoor application, the housing must be able to withstand buffeting by the elements, without degradation of the performance of the projector. It must also be rugged to withstand a certain amount of abuse to be expected in an outdoor, public, unsupervised application and be economical to produce to be competitive.

The optical system of an outdoor framing projector should also be easily adjustable during daylight hours. In theatrical projectors, the optical system could be adjusted by darkening the room in which the projector was being used. That is not the case outdoors, and the adjustment must be able to be performed easily during normal working hours, during the day. Zoom and focus adjustments must also be easy to perform and rugged to maintain their positions.

SUMMARY OF THE INVENTION

The invention provides a projector which addresses and satisfies the above needs. A projector of the invention has a housing and means sealing the interior and the exterior of the housing against substantial air exchange. An optical system within the housing projects a beam of light out the front of the housing which can be varied in size and focus at a distance from the housing. Since the projector is sealed, it can be used outdoors. Since it has a variable size and focus beam, it can be used to project sharply defined images or patterns of light of variable size, so that it can be used in the applications described above. In this regard, the projector is preferably provided with a shutter support for changing the shape of the beam and/or the pattern of light cast by the projector.

In another aspect, the invention provides cooling of a luminaire which is particularly adapted for cooling such a luminaire with a sealed housing. In this aspect, a fan recirculates the interior air of the housing past the light source, preferably at the rear of the housing, and then to the front of the housing. Preferably, after passing the light source, the air flows past one or more heat conductive surfaces of the housing which have heat dissipating fins for cooling the air. A return air duct which receives air from the front of the housing is formed between an interior baffle within the housing and a wall of the housing. The duct preferably runs from the front to the rear of the housing to supply the intake of the fan. An open channel is preferably defined adjacent to the opposite wall through which air may flow toward the front of the housing. In this aspect, especially where an light source is used which requires fan forced cooling, cooling can be provided without the necessity of air exchange between the interior and the exterior of the housing.

In another useful aspect, the invention provides a luminaire housing made up of extruded sections for at least the sides and the bottom of the housing. Each pair of adjacent sections interfit in a longitudinally continuous connection including a longitudinally continuous lip on one of the sections. The lip is received within a longitudinally continuous recess of the other adjacent section, and a longitudinally continuous compression strip is compressed between a leading surface of the lip and a surface of the recess which is opposite from the leading surface. The compression strip can be made of a sealing material so as to create a longitudinally continuous seal at the joint. Preferably, the lip has a longitudinally continuous heel on a trailing surface of the lip which is opposite from the leading surface, and the recess defines a longitudinally continuous ridge on a surface opposite from the trailing surface. The heel engages in a detent position behind the ridge and is biased in that position by the compression strip to provide a detent lock in that position. With this construction, a rigid, sealed housing of a complex cross-section and a relatively large overall size can be economically and efficiently made in various lengths, and which provides convenient access to the components contained within the housing.

In another aspect, the invention provides for facile adjustment of the optical system of a luminaire. For proper operation of the optical system of a projector, the light source must be positioned relative to a reflector of the optical system so as to produce a focusable beam of generally uniform intensity emanating out the front of the housing. For a projector to be used outdoors, it is desirable to be able to perform this adjustment in daylight. To accomplish this adjustment according to this aspect of the invention, the reflector is provided with at least two spaced apart holes which allow the escape of two reference beams generally laterally of the direction of the beam. A reference mark is provided in the interior of the housing for each reference beam, each reference beam being aligned with its corresponding reference mark when the lamp is properly positioned relative to the reflector so as to produce the desired beam. In this regard, a cover is preferably provided over the reference marks to shade them so that alignment of the reference marks and the reference beams can be visually detected in daylight.

In yet another aspect, the invention provides for adjustably supporting a lens in a luminaire. Longitudinal flanges are provided at opposite sides of the housing and a lens support for supporting a lens from the flanges has a plate to which the lens is secured. The plate extends in a lateral plane and each side of the plate has a slot to receive a corresponding longitudinal flange. A bearing support block is fixed to and extends longitudinally from the plate, the block defining an open longitudinal channel therethrough in alignment with the slot of the plate for receiving a corresponding one of the flanges. The bearing support block has an upper side extending from the plate on the upper side of the channel and a lower side extending from the plate on the lower side of the channel. A bearing having a cylindrical outer surface extends longitudinally and is positioned between the upper side of the block and the corresponding flange. A clamp stand is associated with each block for lifting the block off the associated bearing and clamping the flange received by the channel between the clamp stand and the lower side of the block. This support allows easy adjustment of the longitudinal position of the len(es) of the optical system and securement of them when the desired position is found. Preferably, the flange has a longitudinally extending cylindrical shaped groove in which a lower portion of the bearing is received and the upper side of the block has a longitudinally extending cylindrical shaped groove in which an upper portion of the bearing is received. The bearing is captured between said grooves to maintain the lens in a lateral plane when its position is being adjusted. A lateral groove is also desirably provided in the bearing to engage the plate so as to secure the bearing longitudinally to the bearing support block.

Many other features, objects and advantages of the invention will be apparent from the drawings and detailed description of the preferred embodiments.

BRIEF DESCRIPTION OF THE DRAWINGS

FIG. 1 is a perspective view of an outdoor framing projector of the invention;

FIG. 2 is a left side elevational view of the projector of FIG. 1, the right side elevational view being a mirror image of the left side;

FIG. 14 is a cross-sectional view as viewed from the plane of the line 14—14 of FIG. 9;

FIG. 15 is a cross-sectional view as viewed from the plane of the line 15—15 of FIG. 14; and FIG. 16 is a perspective view of the upper left portion of a lens support used in the projector of FIG. 1, FIGS. 14 and 15 showing the upper right portion of the lens support.

DETAILED DESCRIPTION OF THE PREFERRED EMBODIMENTS

Figures 3, 4, 5:
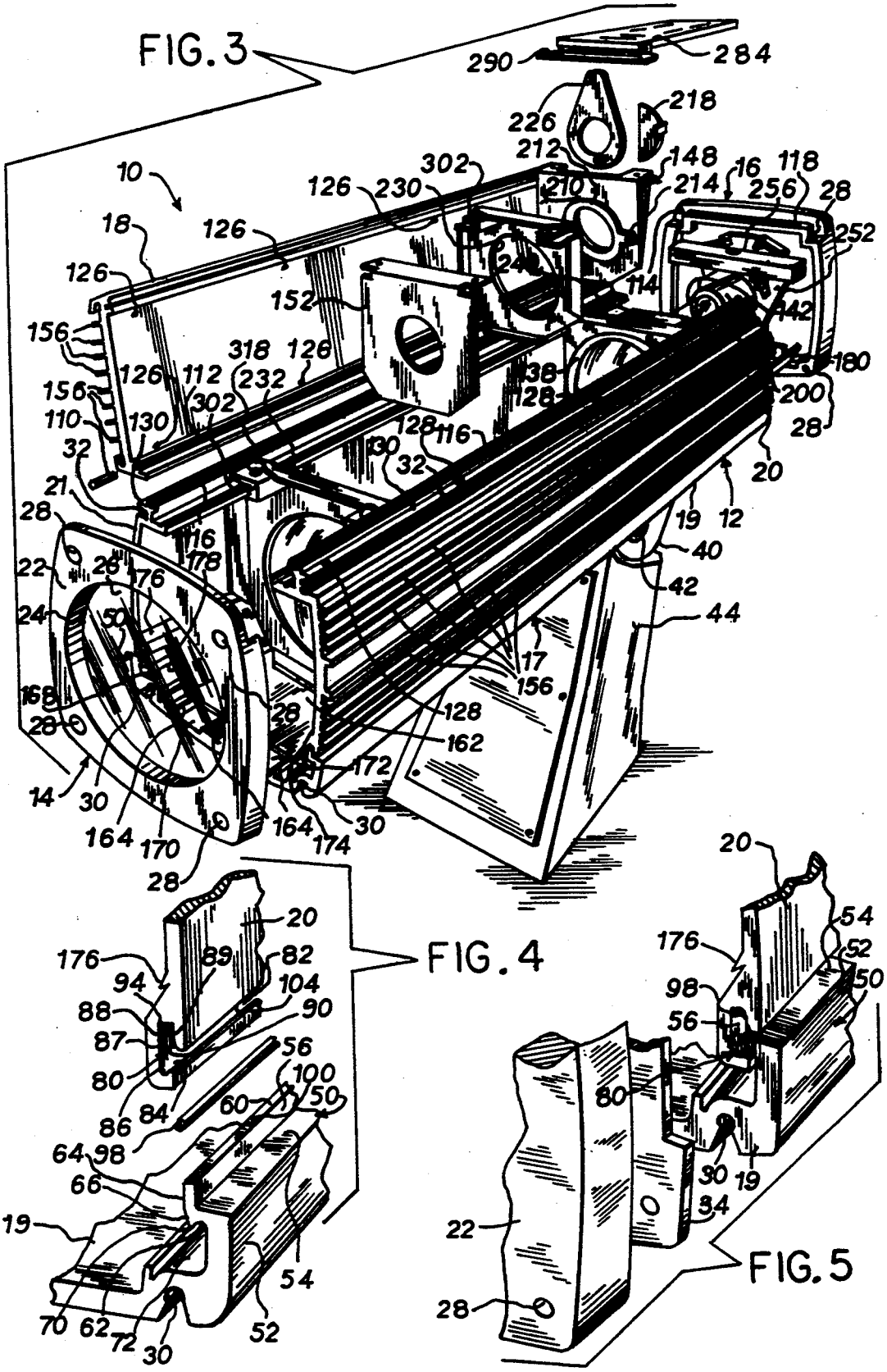
FIG. 3 is an exploded perspective view of the projector of FIG. 1, shown with a mounting base.
FIG. 4 is an exploded perspective detail view of the left (as viewed from the back of the projector) front corner portion of the projector shown in FIG. 3.
FIG. 5 is a view similar to FIG. 4 showing the parts shown in FIG. 4 assembled and also showing a front cover and gasket for the projector.

FIG. 1 illustrates an outdoor framing projector 10 of the invention. The projector 10 has a housing 12 which extends longitudinally from a front cover 14 to a rear cover 16. The housing 12 also has between the front and rear covers 14 and 16 a casing 17 with a top section 18, a bottom section 19 and left and right sections 20 and 21 (see FIG. 3 also). The front cover 14 has a front plate 22 with an aperture 24 covered by a glass plate 26 through which the projector 10 projects its beam.

Preferably, the sections 18–21 of the projector 10 are extruded aluminum. By being extruded, the sections 18–21 may have relatively complex cross-sectional shapes. Also, since they are extruded in long lengths, the sections 18–21 may be cut to any desired length, which is especially desirable so as to allow varying the length of the projector housing 12 to accommodate different optical systems. Aluminum is the preferred material of the sections 18–21 because it has high heat conductivity, which helps keep the interior of the housing 12 relatively cool. Also, aluminum is extrudable in complex shapes, is rigid and durable.

Figure 7:
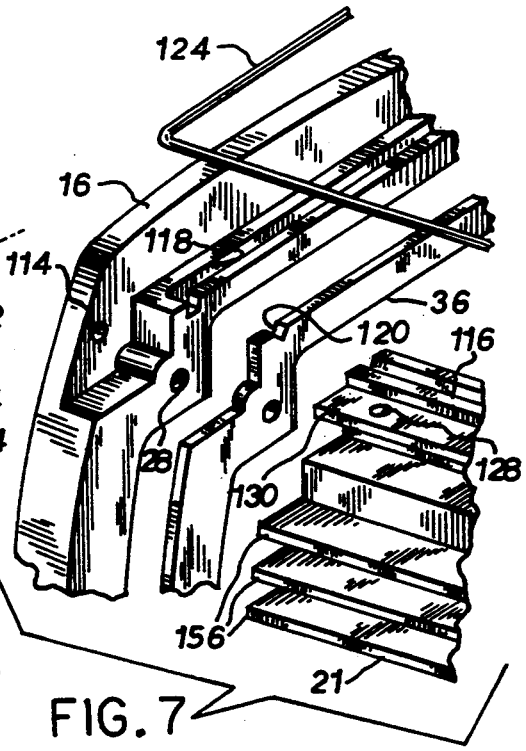
FIG. 7 is an exploded perspective detail view of the right (as viewed from the back of the projector) rear corner portion of the projector of FIG. 3.

The rear cover 16 and front plate 22 are also preferably aluminum, but in the preferred embodiment are cast. The same covers 14 and 16 may be used regardless of the length of the housing 12. Each of the covers 14 and 16 is provided with four holes 28 near the corners through which screws (not shown) extend and are screwed into extruded holes 30 in the bottom section 19 and extruded holes 32 in the left and right sections 20 and 21. The left and right sides 20 and 21 in the preferred embodiment are identical, one being flipped longitudinally end to end relative to the other so that they face in opposite directions to form the housing 12. In addition, referring to FIGS. 5 and 7, a gasket 34 resides between the front cover 14 and the sections 18–21 and a gasket 36 resides between the rear cover 16 and the sections 18–21. The front gasket 34 is also preferably sandwiched between the glass plate 26 and the front plate 22 so as to seal the interface between the glass plate 26 and the front plate 22 against any substantial entry of dirt, dust and moisture.

The housing 12 may be provided with a knuckle 40 bolted to the bottom side 19 by any suitable means. Preferably, the interface between the knuckle 40 and the bottom side 19 is sealed. The housing 12 may be pivotable about a generally vertical axis as viewed in FIGS. 1 and 2 relative to the knuckle 40, and such pivoting can be allowed by providing an o-ring type seal between the knuckle 40 and the bottom side 19.

The knuckle 40 extends downwardly and has a hole 42 therethrough for securing it to a mounting base 44 or other suitable support structure. Preferably, the housing 12 is also rotatable about hole 42 so as to allow aiming the projector 10. The mounting base 44 is suited to mount the projector on a flat surface such as a horizontal platform, a floor or a vertical wall. Other support structures may be substituted for the mounting base 44, however, for example for mounting the projector 10 to a pole.

The casing 17 is preferably made in sections, because making it of a unitary construction having integral sides would require a very large and heavy structure to be formed and would make it difficult to access the internal components of the projector 10. Referring specifically to FIGS. 3–6, the side sections 20 and 21 are connected and interfit in a longitudinally continuous joint. A longitudinally continuous lip 50 is formed at each side of the bottom section 19. The lip 50 is dog-leg shaped, having a generally vertical trailing portion 52, a laterally extending connecting web 54 and a generally vertical upwardly standing leading portion 56. At its upper end, the leading portion 56 has a leading surface 60 which is generally horizontal in the preferred embodiment. Opposite from the leading surface 60, the lip 50 has a downwardly facing trailing surface 62. An inner side 64 of the leading portion 56 is relieved at 66, and surface 66 meets with trailing surface 62 at a heel 70 of the trailing surface 62. This dog-leg shape of the lip 50 forms an open space 72 below the trailing surface 62.

Each side section 20 and 21 forms a longitudinally continuous recess 80 at its lower edge which is shaped to receive the lip 50 in a locked engagement. Each recess 80 has an open entry slot 82 adjacent to the lower end of the recess. The lower edge of the entry slot 82 is defined by a ridge 84 formed by the lower end 86 of the recess 80. The recess 80 extends upwardly from its lower end 86 past the slot 82 to define a capturing portion 88 above the slot 82 which has three sides closed. The near side 89 of the capturing portion 88, which is adjacent to the slot 82, is relieved at 90 and the top of the capturing portion 88 is defined by a closed end surface 94 at the top of the near side 89. The capturing portion 88 is also defined by a far side 87, which extends from the closed end surface 94 to the open end surface 86.

A compression strip 98 which extends for the length of the casing 17 is laid into the recess 80 before the lip 50 is inserted into it to be compressed between the leading surface 60 and the closed end surface 94. The leading surface 60 has a longitudinally continuous rib 100 and the closed end surface 94 has a longitudinally continuous rib 102 which concentrates the compression of the compression strip 98 between the ribs 100 and 102. Preferably, the compression strip 98 is made of a resilient elastomeric material, such as silicone rubber, so as to form a water, dirt and dust resistant seal between the bottom section 19 and the corresponding side sect ion 20 or 21.

Figure 6:
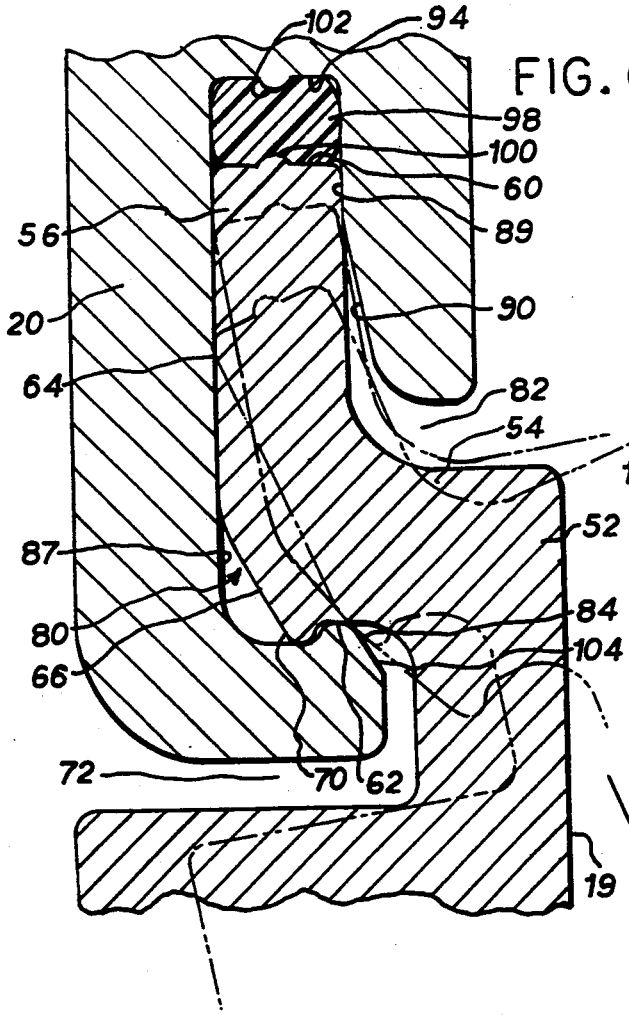
FIG. 6 is a cross-sectional view of the assembled elements of FIG. 5 and illustrating in phantom lines the elements at various stages of assembly.

A side section 20 or 21 is assembled to the bottom section 19 in the manner illustrated in FIG. 6. FIG. 6, illustrates only the side section 20, it being understood that the side section 21 is assembled to the bottom section 19 in a similar manner. The phantom lines in FIG. 6 indicate that it is the bottom section 19 which is rotated relative to side section 20, although it should be understood that the side section could be rotated while holding the bottom section relatively stationary, or that both sections could be rotated simultaneously so as to insert the lip 50 into the recess 80.

The leading portion 56 is first inserted into the entry slot 82 with the leading surface 60 generally pointing up toward the closed end surface 94. As the leading portion 56 is rotated up into the capturing portion 88, the reliefs 66, 90, and a relief 104 adjacent to the ridge 84 at the lower edge of the slot 82 allow clearance for the leading portion 56 to be inserted up into the capturing portion 88. Near the top of the capturing portion 88, above the relief 90, the capturing portion 88 has a lateral dimension substantially the same as the lateral dimension of the leading portion 56, so as to eliminate substantial play but allow the leading portion 56 to be slid therein.

As the leading surface 60 is moved up through the capturing portion 88, it begins to compress the compression strip 98 against the closed end surface 94. The compression of the compression strip 98 continues as the heel 70 cams up over ridge 84. When heel 70 clears ridge 84, compression strip 98 biases the heel 70 down behind the ridge 84 to create a longitudinally continuous detent connection between the side section 20 and the bottom side 19 which helps prevent the side section from rotating relative to the bottom section, which rotation could result in the loss of the connection between the lip 50 and the recess 80.

Figure 8:
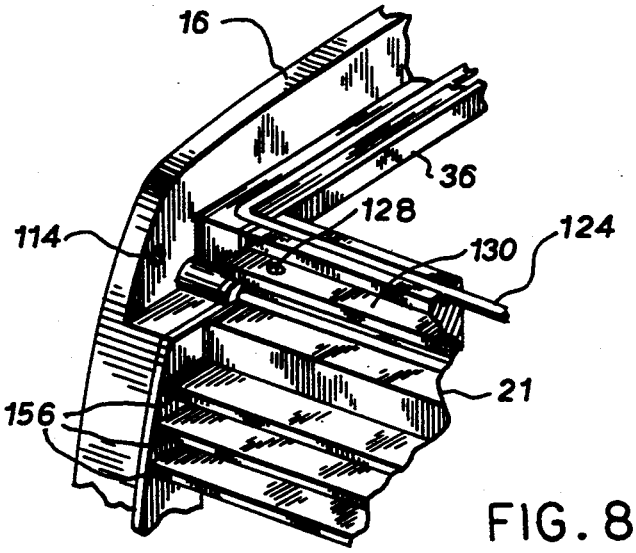
FIG. 8 is a view similar to FIG. 7 but showing the elements shown in FIG. 7 assembled.

Once both side sections 20 and 21 are assembled to the bottom section 19 in this manner, a steel roll pin 110 is pressed into each end of an extruded hole 112 of the top section 18, with ends of the roll pins 110 projecting out to be received in holes 114 (only the rear one of which is shown in the rear cover 16 in FIGS. 3, 7 and 8) to form a hinge connection of the top section 18 to the front plate 22 and the rear cover 16. The ends of the compression strips 98 seal against the respective front and rear gaskets 34 and 36 when the front and rear covers 14 and 16 are screwed into the casing 17.

A groove is formed around the peripheral top surfaces of the side sections 20 and 21 and front and rear covers 14 and 16 where the top section 18 interfaces with the remainder of the housing 12. This groove is defined by a groove 116 in each of the side sections 20 and 21 (FIGS. 3 and 7), a groove 118 in each of the front and rear covers 14 and 16, and v-shaped notches 120 in the front and rear gaskets 34 and 36 which are in registration with the grooves 116 and 118. A sealing strip 124 made of a sealing, resilient elastomeric material such as silicone rubber is laid into the endless groove created by the grooves 116, 118 and 120 and has overlapping ends cut at an angle as is well known to form an endless seal between the top section 18 and the remainder of the housing 12 when the top section 18 is closed. Preferably, a plurality of screws 126 are provided in the top section for being threaded into holes 128 in flanges 130 of the side sections 20 and 21 so that after the top section 18 is closed, the screws 126 can be tightened to compress sealing strip 124 and thereby create a substantial seal against the entry of dirt, dust and moisture.

Figure 9:
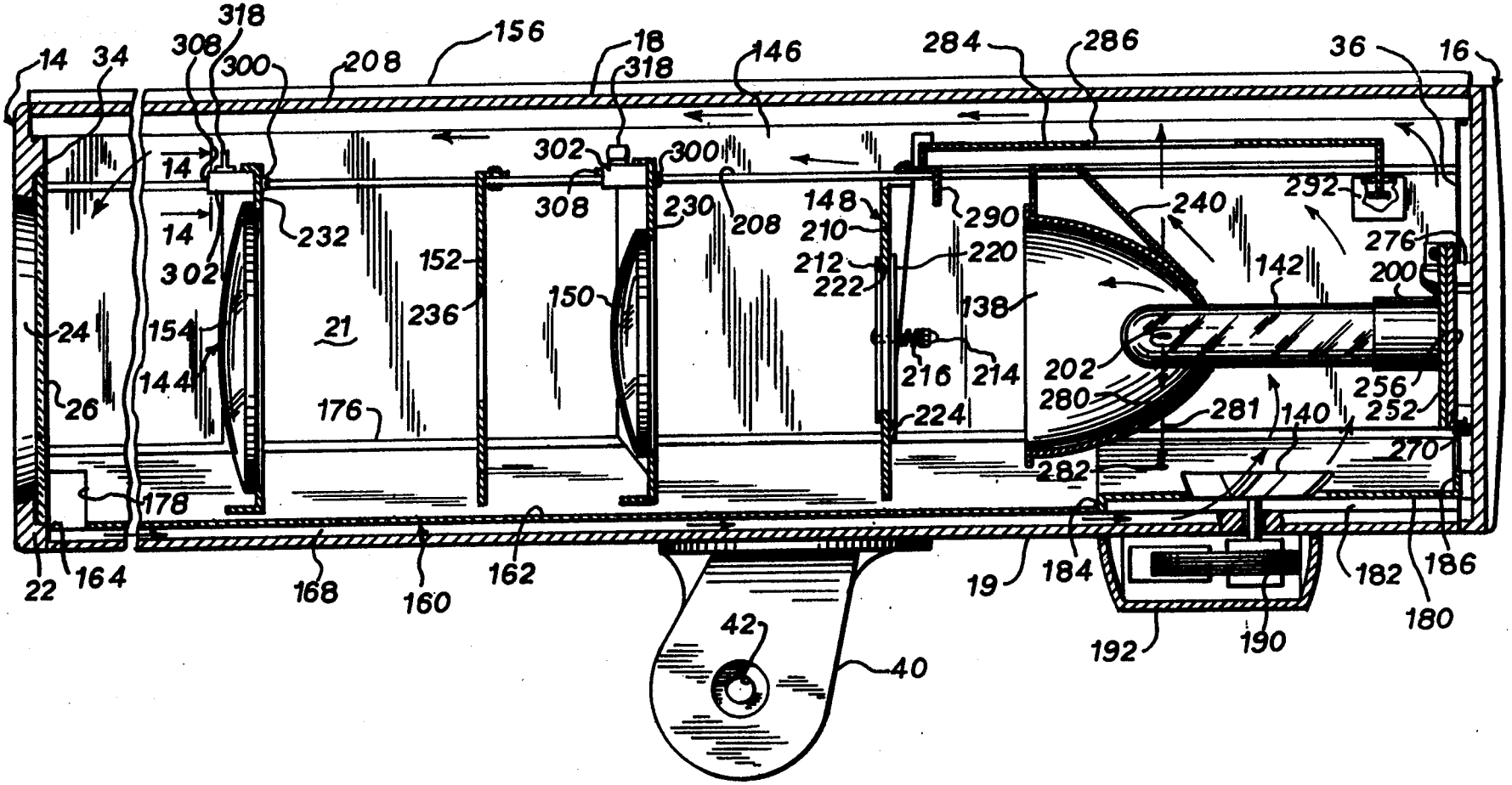
FIG. 9 is a longitudinal cross-sectional schematic view of the projector of FIG. 1 illustrating an air flow path through the projector and other features of the invention.

Referring now specifically to FIG. 9, in one preferred form a projector of the invention may be provided with a fan forced cooling system. Fan forced cooling is most desirable when an incandescent lamp is used for the light source of the projector. If a high intensity discharge metal halide lamp is used, which operates at lower temperatures, a fan forced cooling system may not be needed.

In the embodiment shown in the drawings, a fan propeller 140 circulates the interior air of the housing 12 to blow cooling air over lamp 142, to thereby reduce its operating temperature. After the air passes the lamp 142, it circulates around the remainder of the optical system 144 by flowing through an open channel 146 defined between the top of the optical system and the top section 18. In the top channel 146, the general direction of the air flow is from back to front, as shown in FIG. 9. The optical system 144, which includes the lamp 142 and a reflector 138, a shutter support 148, a rear lens 150, an optical stop 152 and a front lens 154, occupies substantially the entire lateral area of the interior of the housing 12, because of the size of the elements required and the need for supports for the elements.

Although spaces are allowable between all the sides of the system 144 and the housing 12, the top channel 146 presents the largest opening for the flow of air so the air flowing from back to front within the housing 12 tends to concentrate its flow in the top channel 146. Desirably, the top section 18 has cooling fins 156 and is made of aluminum, which has a high coefficient of thermal conductivity to cool the air flowing the the channel 146 along side of the top section 18. Side sections 20 and 21 also preferably have cooling fins 156 and, as mentioned above, are also made of aluminum, to help cool air flowing along side the side sections.

When the flow of air in top channel 146 and along the sides of the optical system 144 clears front lens 154, it turns downwardly to flow through the space between front cover 14 and the optical system 144. A duct 160 is defined adjacent to the bottom section 19 in the interior of the housing 12. A sheet metal baffle 162 is supported on top of ribs 164 formed on the interior side of the bottom section 19 so that return air flow channels 168, 170, 172 and 174 are formed between the baffle 162 and the bottom section 19. The sides edges of the baffle 162 are trapped beneath lips 176 formed on the interior sides of the left and right sections 20 and 21. The baffle 162 is cut out at 178 adjacent to front cover 14 to allow for the entry of the return air into the front of the duct 160.

Figure 10:
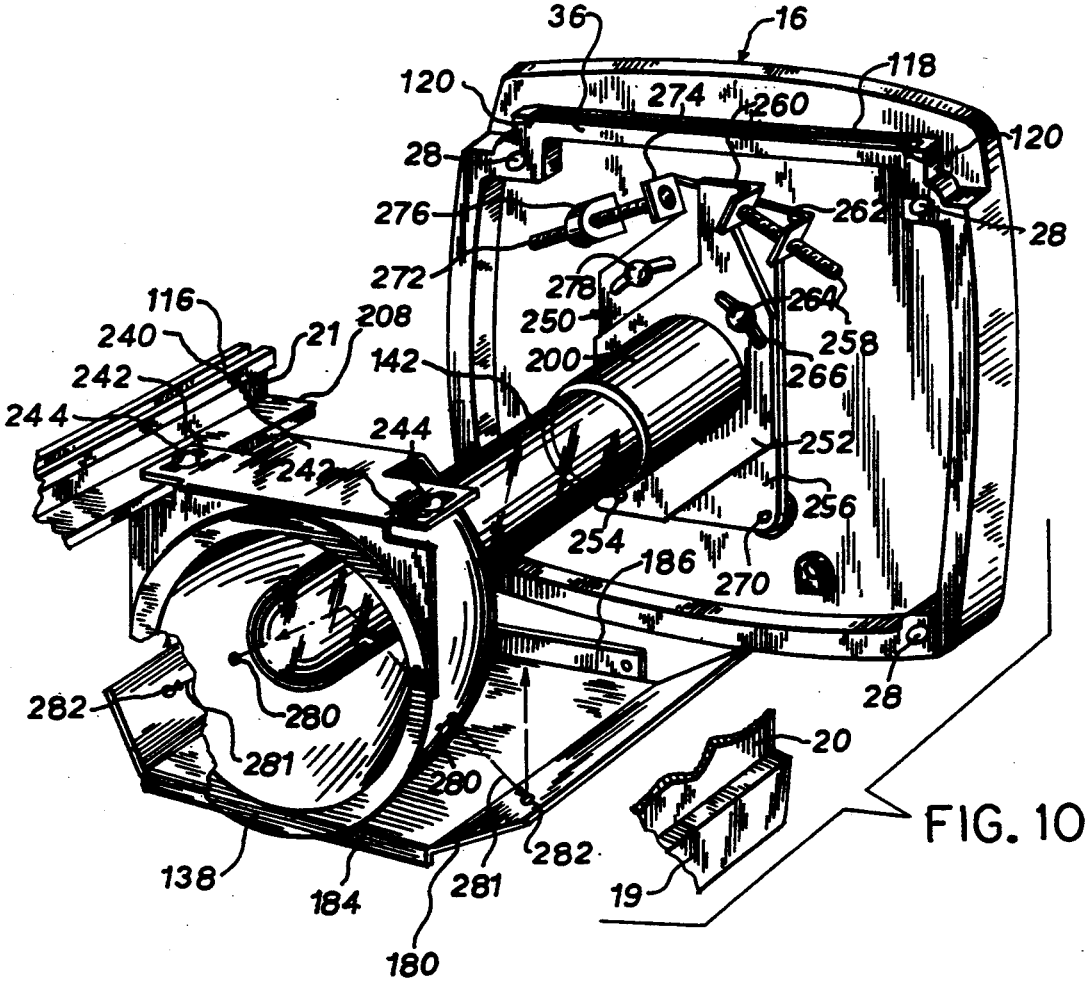
FIG. 10 is an exploded perspective view of a rear portion of the projector shown in FIG. 3.

The air flows generally from front to back in the duct 160 to supply air to the fan propeller 140. At the rear end of the baffle 162, another sheet metal plate 180 defines a somewhat enlarged plenum 182 to allow for the accumulation of return air from the channels 168, 170, 172 and 174 of duct 160 to supply the propeller 140, which is elevated above the ribs 164. The plate 182 has its side edges trapped beneath lips 176 in the same manner as the baffle 162, has its front end supported on top of the ribs 164 by flange 184 (FIG. 9) and has a rear flange 186 which is secured by screws (not shown) to the rear cover 16 (FIG. 10).

The fan propeller 140 is driven by an electric motor 190 which is secured to the housing 12 by suitable means (not shown) and the motor 190 is enclosed by motor cover 192 which is sealed to the bottom section 19 about its edges and secured to the bottom section 19 by fasteners extending through the top of bottom section 19 and screwed into the cover 192. Wires (not shown) for providing power to the motor 190 may be routed to the interior of the housing 12 through the mounting base 44 and knuckle 40, as may the wires for the lamp 142.

In the preferred embodiment, the bottom side 19 does not have cooling fins 156 because the bottom section 19 is desired to have a flat exterior surface for mounting and sealing the knuckle 40 thereto and for mounting and sealing the motor cover 192 thereto. It is noted that the flow of cooling air through the duct 160 adjacent to the bottom section 19 is much faster than it is adjacent to the top section 18 and the side sections 20 and 21. In addition, the highest temperature air is that which has just blown past the lamp 142 and is therefore in the vicinity of the top section 19 toward the rear of the housing 12. As the air flows forwardly, it is cooled, thereby reducing its temperature. While there may be a temperature drop from the front of the duct 160 to the rear, the temperature drop is greater as the air flows forwardly.

Figure 11:
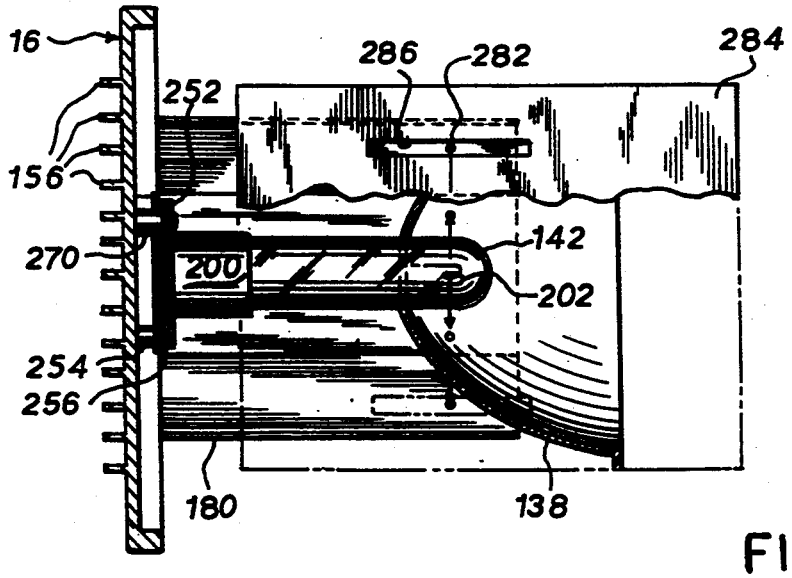
FIG. 11 is a top detail view of the rear portion of the projector.

Referring particularly to FIGS. 10–13, the lamp 142 extends forwardly from socket 200 to position its filament, identified at 202 in FIG. 11 within reflector 138. The reflector 138 in the preferred embodiment is a double facetted ellipsoidal specular Alzak processed aluminum reflector. Such reflectors are well known in the art and commercially available from several sources. One such reflector found suitable is commercially available from Reflek Corporation of Fall River, Mass. under the commercial designation 360-Q.

As noted above, the lamp 142 is preferably either an incandescent lamp, such as a quartz lamp for example if the projector 10 is to be used in a dimming application, or a metal halide high-intensity discharge lamp, which may be desired for long life and operating economy. Both lamp types preferably operate off a 120 volt A.C. source of electrical power. Such lamps are well known in the art. An incandescent lamp, which is shown in the drawings and has been found suitable for use with the reflector specified above is commercially available from GTE Products Corp., OEM Division, of Westfield, Ind., under the commercial designation Sylvania TM EGG, 750 W, Quartz, Medium Prefocus. This is a 750 watt lamp, it being understood that smaller or larger wattages may also be used.

The shutter support 148 is positioned at the focal point of the optical system 144. Referring particularly to FIG. 9, the shutter support 148 has an apertured main plate 210 secured to flanges 208 of side sections 20 and 21 by suitable fasteners (not shown) and a circular strap-like support plate 212 provided at each side with a fastener 214 and spring 216 to bias the support plate 212 against the main plate 210. Multiple, for example 4, shutters 218 (FIG. 3) may be slid in between the support plate 212 and the main plate 210 so as to create a beam of any desired outer shape. On the back side of the main plate 210, a guide 220 is provided on each side of aperture 222 through the main plate 210 and a stop 224 is provided at the bottom of the guides 220. Any desired pattern, for example the pattern of a tree, many of which are commercially available and well known, may be slid into a pattern holder 226 (FIG. 3) and the pattern holder 226 received by the guides 220 to create the desired pattern in the beam emanating from projector 10. The pattern holder 226 has a rounded teardrop shape diameter of from 14 to 28 feet with an intensity of from 31 to 7 footcandles, respectively. In a wide angle system, the rear lens 150 may be a 4.5" diameter, 9" focal length lens and the front lens 154 may be a 6" diameter, 12" focal length lens. In this system, the beam angle is adjustable from 16° to 32°, with a beam diameter of approximately 28 to 57 feet at a throw of 100 feet and respective intensities of from 10 to 4 foot candles (using the specified reflector and the same bulb but in a 500 watt designation).

Should it be desired to use a metal halide high intensity discharge lamp, such a lamp found suitable is commercially available from Osram of Montgomery, N.Y., under the commercial designation HQI-T250W/D-US. A reflector suitable for use with this lamp is also a double facetted ellipsoidal specular Alzak processed aluminum reflector, and is well known in the art. A particular one found suitable is commercially available from Major Reflector Products of Northbrook, Ill. under the commercial designation PX00100101. Such a lamp and reflector may be used with either a narrow angle or a wide angle lens system as described above. When so used, the beam size ranges are the same as for the incandescent system, but the intensities differ somewhat. For the narrow angle metal halide high intensity discharge system, at a 100 foot throw, the intensity at 8° is approximately 12 footcandles and the intensity at 16° is approximately 5 footcandles. For the wide angle metal halide high intensity discharge system, at a 100 foot throw, the intensity at 16° is approximately 8 footcandles and the intensity at 32° is approximately 3 footcandles.

The optical stop 152 is provided with an aperture 236 which allows only the passage of controlled light. Clamps or supports (not shown) may also be provided on optical stop 152 for supporting a filter (not shown) over aperture 236, for example a colored glass plate, so that the color of the projected beam may be changed as desired.

For a narrow beam incandescent projector, the housing 12 is approximately 37 inches long. For a short throw incandescent projector, the housing 12 can be made substantially shorter, for example 27 inches long. Lateral dimensions for both housings are approximately 10×10 inches. Housings for the high intensity discharge embodiments having long and short throw optical systems are approximately 2.6 inches longer than the respective housings of the incandescent embodiments, because the high intensity discharge lamp is approximately that much longer than the incandescent lamp. so that it may be rotated within the guides 220 to adjust the angle of the pattern.

Rear lens 150 is positioned between shutter support 148 and optical stop 152, and the front lens 154 is positioned on the opposite side of the optical stop 152. The lenses 150 and 154 are supported by respective lens support plates 230 and 232. The lenses 150 and 154 are each plano-convex lenses preferably made of heat resistant Pyrex. The diameters and focal lengths of the lenses 150 and 154 are chosen to provide the desired throw, beam width, focusing and zoom characteristics of the projector. A projector of the invention may be provided having a narrow or a wide angle beam, and preferably, whether generally narrow or wide, the angle of the beam (zoom) is adjustable to provide a focused image or pattern of variable size. In narrow angle optical system, lens 150 is a 6 inch diameter lens with a focal length of 12 inches and lens 154 is an 8 inch diameter lens with a focal length of 20 inches. These lenses provide a beam angle which is adjustable from 8° to 16° with a throw of from about 10 feet to approximately 500 feet while maintaining sharp focus. Of course, the intensity of the projected image decreases as the distance from the projector increases, but at a throw of 100 feet with the lamp, reflector and lenses specified above, a beam can be produced of a The lamp 142 must be positioned relative to the reflector 138 so as to place the light source produced by lamp 142, which is actually produced by the filament 202, at the focal point of the reflector 138. To accomplish this positioning, the reflector 138 is supported by reflector support plate 240, which is secured to the reflector 138. The reflector support plate 240 has slots 242 formed therein (FIG. 10) and screws 244 extending through the slots 242 and threaded into flanges 208 of the corresponding side sections 20 and 21. This connection provides for adjustment of the longitudinal position of the lamp 142 relative to the reflector 138.

Lateral positioning (i.e., in the plane perpendicular to the longitudinal direction) of the lamp 142 relative to the reflector 138 is accomplished by adjustable mount 250 which mounts socket 200 to the rear cover 16. Referring particularly to FIG. 10, mount 250 includes a first plate 252 which mounts socket 200 and is connected at pivot point 254 to pivot relative to second plate 256. Pivoting of the first plate 252 relative to the second plate 256 is accomplished by turning threaded screw 258 which turns freely in flange 260 of the first plate 252, is axially captured by flange 260 and is threaded in flange 262 of plate 256. Pop rivet 264 is secured to plate 256 and rides in slot 266 of plate 252 to keep the plates 252 and 256 together.

A similar connection connects plate 256 to the rear cover 16. Plate 256 is connected to cover 16 to pivot about point 270 and has screw 272 axially captured by flange 274 of plate 256 and screwed into projection 276 of cover 16. Pop rivet 278 secured to cover 16 allows pivoting plate 256 relative to cover 16 while maintaining the plate 256 against the cover 16. By pivoting the plates 252 and 256 relative to each other and relative to the cover 16, lamp 142 can be laterally positioned as desired relative to reflector 138.

Two holes 280 are bored in reflector 138 and a reference mark 282 corresponding to each hole 280 is defined on plate 180. The reference marks 282 may be either marks on the surface of the plate 180 or holes or indents in the plate 180. Light from the lamp 142 shines through the holes 280 to create reference beams 281 which impinge upon the marks 282 when the lamp 142 is adjusted properly relative to the reflector 138.

Referring particularly to FIGS. 9, 11, 12 and 13, a cover 284 is provided over the reflector 138 and the rear portion of lamp 142 so as to shade the reference marks 282 from ambient, exterior light, so that the position of the lamp 142 relative to the reflector 138 may be adjusted during daylight hours. Peepholes 286 are provided in each side of the cover 284 which provide a line of sight to the reference marks 282. Preferably, shields 288 are provided on the underside of cover 284 which prevent a line of sight from the peepholes 286 to the lamp 142. Lateral adjustments provided by the mount 250 are accessible when the cover 284 overlies the reflector 138. In addition, the cover 284 may be provided with ventilation slots (not shown) to allow air to pass through the cover 284.

Figure 12:
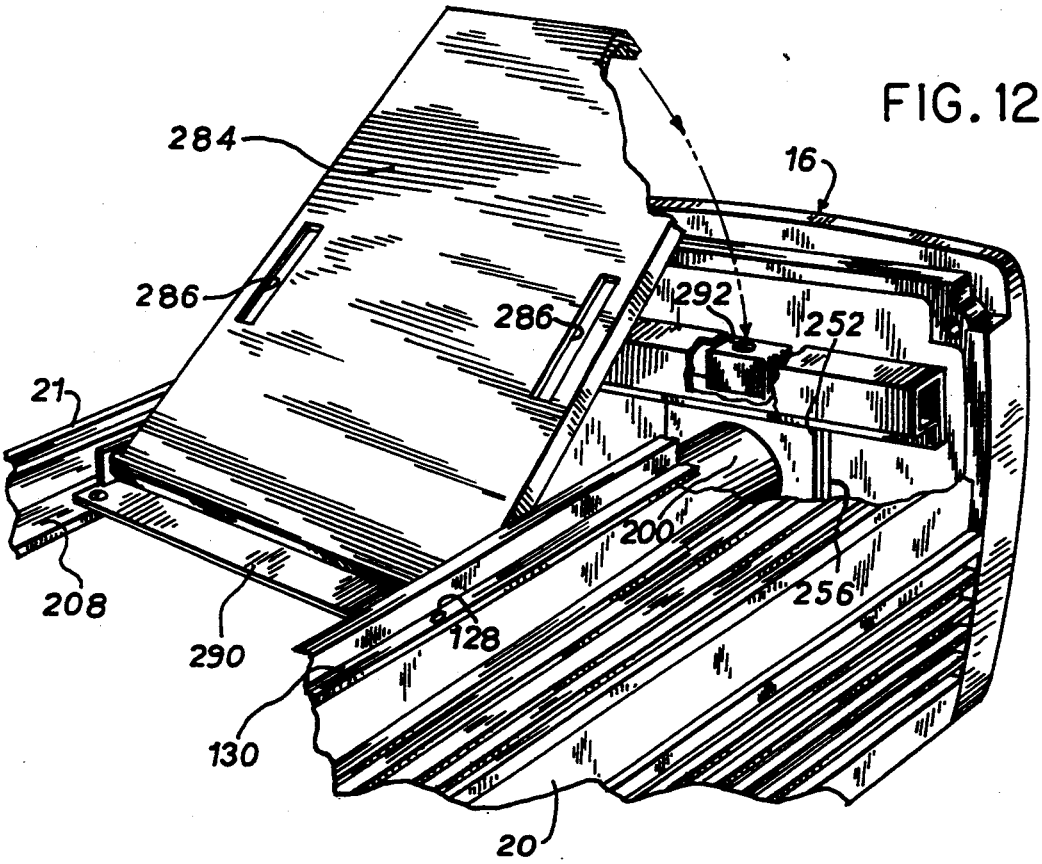
FIG. 12 is a fragmentary perspective view of the rear portion of the projector.
Figure 13:
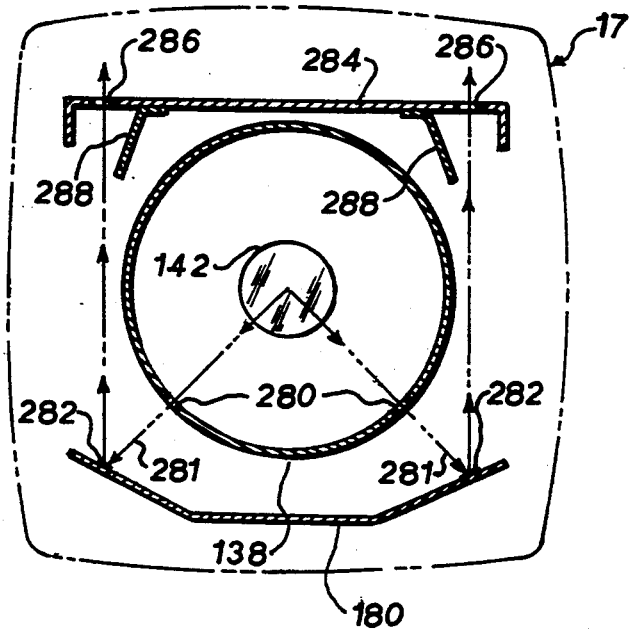
FIG. 13 is a lateral cross-sectional view illustrating the light flow path of reference beams which are used to adjust the position of the light bulb relative to the reflector in the projector of FIG. 1.

The cover 284 is preferably hinged at its forward end, as best shown in FIG. 12. Hinge plate 290 is secured at its ends to flanges 208 of the respective side sections 20 and 21. A lockout switch 292 is preferably provided which is deactuated by opening cover 284, so as to turn off power to the lamp 142 and, if desired, also to the fan motor 190.

The zoom and focus of the projected beam is adjusted by changing the axial (longitudinal) position of the lenses 150 and 154 relative to one other and relative to the other elements of the optical system. Therefore, it is desirable to provide for easy adjustment of the longitudinal positions of the lenses 150 and 154 and locking of the lenses in their positions.

Referring particularly to FIGS. 14–16, the connection of the lens support plates 230 and 232 which provides for longitudinal adjustments of the lenses 150 and 152 are the same, and are the same from side to side. Therefore, only the connection of plate 232 to section 20 is shown in detail in the FIGS. 14–16, with FIGS. 14 and 15 showing the right side connection (as viewed from the back of the projector) and FIG. 16 showing the left side.

Referring particularly to FIGS. 14 and 15, plate 232 is secured by screws 300 to a bearing support block 302, which is preferably a section of an aluminum extrusion. Block 302 defines a longitudinal channel 304 which is open at its side and receives within it flange 208 of section 21. A longitudinal groove 306 having a cylindrical surface is formed in a downwardly facing surface of channel 304 and receives a solid or tubular plastic bearing 308. Bearing 308 has a slot 310 which receives an edge 312 of plate 232. Edge 312 is the upper side of a side-opening slot 314 formed at the side of plate 232 which is aligned with channel 304. Edge 312 fitting in slot 310 secures bearing 308 longitudinally in groove 306.

A lower surface of bearing 308 is slidable in longitudinal cylindrical groove 316 formed in the upper surface of flange 208. Bearing 308 is trapped between groove 306 and groove 316 such that even when channel 304 is abutting the lower side of flange 208, bearing 308 remains trapped between the grooves 306 and 316. A clamp stand 318, a thumb screw in the preferred embodiment, is threaded into block 302 to extend into the channel 304 from the top thereof and bear in a longitudinally running v-shaped groove 320 formed in the upper surface of flange 208. To adjust the longitudinal position of lens 154 supported by plate 232, clamp stand 318 is backed off to clear flange 208. In this position of stand 318, the entire weight of lens 154, plate 232 and bearing support block 302 is born by bearing 308.

Since bearing 308 is made of a lubricious plastic material, plate 232 can be slid longitudinally so as to adjust its position for purposes of zoom and focus adjustment of the beam projected by the projector 10. Since the bearing 308 runs longitudinally, as do the grooves 306 and 316, as the position of the lens 154 is changed, the bearings 308 maintain the lens in a plane which is substantially perpendicular to the beam direction, (i.e., which is lateral to the longitudinal direction).

When the proper longitudinal position of the lens 154 is found, the clamp stands 318 on each side of the plate 232 are tightened to bear into slot 320 and lift support block 302 above bearing 308. The bottom of channel 304 abuts the bottom of flange 208 so that the screws 318 clamp the flanges 208, so as to maintain the position of the lens 154. Even in the clamped position, edge 312 stays within slot 310 so as to maintain the bearing 308 in longitudinal position relative to the block 302. The clamp stands 318 bearing in v-shaped grooves 320 helps maintain the lateral position of lens 154 and also helps provide for secure engagement of the flange 208 by screw 318.

Preferred embodiments of the invention are described in considerable detail above. Many modifications and variations to the preferred embodiments will be apparent to those of ordinary skill in the art, but will still embody the spirit and scope of the invention. Therefore, the invention should not be limited by the particular embodiments shown in the figures and described, but should be defined by the claims, which follow.

We claim:

1. An outdoor framing projector, comprising:

a housing having an interior, an exterior, a front and a back;

means sealing said housing against substantial air exchange between the interior and the exterior of said housing;

an optical system including a light source and a lens system within said housing for projecting a beam of light of a certain size, shape and focus out the front of said housing and for varying the size and focus of said beam at a distance from said housing; and a shutter support for changing the shape of said beam at said distance, said shutter support including a pattern holder for holding a pattern which defines a pattern of light projected at said distance.

2. An outdoor framing projector as claimed in claim 1, wherein said shutter support includes means for holding one or more shutters.

* * * * *

UNITED STATES PATENT AND TRADEMARK OFFICE

CERTIFICATE OF CORRECTION

PATENT NO. : 5,404,283

DATED : July 3, 1995

INVENTOR(S) : Yantz, et al

It is certified that error appears in the above-indentified patent and that said Letters Patent is hereby corrected as shown below:

Move the text starting with "so that it may be rotated" in Column 10, Line 26 and ending with "beam can be produced of a" Column 10, line 52 to Column 9, line 46 between "shape" and "diameter of from 14 to 28 feet."

Signed and Sealed this

Twenty-ninth Day of August, 1995

*Attest:*

Bruce Lehman

BRUCE LEHMAN

*Attesting Officer*

*Commissioner of Patents and Trademarks*